United States Patent [19]

Heidebroek

[11] 3,976,232

[45] Aug. 24, 1976

[54] DEVICE FOR EMPTYING SILOS FOR BULK MATERIAL, PROVIDED WITH A FLAT OR SLIGHTLY INCLINED BOTTOM

[75] Inventor: Reinhard H. H. Heidebroek, Hamburg, Germany

[73] Assignee: Claudius Peters AG, Hamburg, Germany

[22] Filed: July 22, 1974

[21] Appl. No.: 490,367

[30] Foreign Application Priority Data

July 20, 1973 Germany ..... 2336984

[52] U.S. Cl. ..... 222/193; 222/462; 52/197

[51] Int. Cl.[2] ..... B65G 3/14

[58] Field of Search ..... 222/193, 195, 462, 547, 222/564; 52/197

[56] References Cited

UNITED STATES PATENTS

| | | | |
|---|---|---|---|
| 2,309,997 | 2/1943 | Thieman | 222/564 X |
| 2,686,617 | 8/1954 | Tolman et al. | 222/195 |
| 3,411,666 | 11/1968 | Schmeling | 222/195 X |
| 3,486,282 | 12/1969 | Moriarity | 52/197 X |

FOREIGN PATENTS OR APPLICATIONS

| | | | |
|---|---|---|---|
| 1,129,892 | 5/1962 | Germany | 222/195 |

*Primary Examiner*—Robert B. Reeves
*Assistant Examiner*—Frederick R. Handren
*Attorney, Agent, or Firm*—Otto John Munz

[57] ABSTRACT

An improvement on a silo for delivery of fluid bulk material, such as livestock feed, grain, flour, spices, sugar, and similar provides for an inner compartment adjacent to the bottom of the silo of the shape approximately of a truncated cone or funnel, with the wider periphery thereof merging with the inside of the cylindrical wall of the silo and with the narrower periphery extending into a shorter vertical wall merging with the bottom of the silo. The lower portion of the cylinder wall of the silo forms with the truncated cone shell within it an annular channel. A central cone rises from the center of the bottom of the compartment. Material release openings are provided within the vertical cone wall and lead from the compartment into the channel.

The channel is provided with a material discharge opening toward the outside of the silo. The bottoms of the compartment and of the channel are suitably inclined to aid the transport of the material.

Outside controls of the sizes of the material release openings are provided.

The bottoms are provided with open airducts which aid the transport of the material and with means to supply pressurized air from the outside controllably to various sections of the device as required. An automatic cyclical distribution control of air is also provided for.

Optimum angles of inclinations of the walls and bottoms over which the materials glide by gravity to its several destinations are demonstrated.

13 Claims, 5 Drawing Figures

DEVICE FOR EMPTYING SILOS FOR BULK MATERIAL, PROVIDED WITH A FLAT OR SLIGHTLY INCLINED BOTTOM

REFERENCE TO A RELATED APPLICATION

Priority of corresponding German Pat. application No. P 23 36 984.8, filed July 20, 1973 is claimed under the Convention.

BACKGROUND OF THE INVENTION

1. Field of the Invention

The invention relates to an emptying device for bulk material, provided with a flat or slightly inclined silo bottom and open air-conveying channels distributed over the silo bottom.

2. Description of the Prior Art

An emptying device is known (German Pat. No. 1,129,892) wherein an open air-conveying channel extends from a central bottom area and leads, below the bottom of the silo chamber, to a lateral silo outlet. The so-called emptying and expansion chamber wherein this air-conveying channel extends is provided with a ventilating device and expands, in comparison with the inlet cross section, to a chamber of large dimensions.

Since, as known, the conveying effect of open air-conveying channels is limited in length, i.e., since with increasing distance from the expansion point the conveying effect decreases, the use of this known emptying device is not practical in silos with a particularly large cross section.

SUMMARY OF THE INVENTION

The primary object of the invention is to create an emptying device which can be used successfully even for silos of a large cross section, in which device the basic idea of the known ventilated emptying and expansion chamber is applied.

Another object of the invention is to provide within the outer slope of the silo bottom, present in silos of large cross section, a ring-shaped ventilable channel which presents several material-feeding openings and at least one material discharge opening and whose bottom, which is inclined with respect to the discharge opening, is provided with open air-conveying channels.

The outer slopes of the silos which are to improve the continuous downward slipping of the bulk material for the purpose of emptying the silo and which are usually made of massive reinforced-concrte fill, can, according to the invention, be rationally utilized for holding the emptying device proper. The volume of the outer slope is therefore no longer shaped as a massive reinforced-concrete rim but can be constructed as a hollow structure by means of reinforced concrete of steel sheets. The ring-shaped channel thus produced contains at least one ventilating device, advantageously provided in the upper area of the ring-shaped channel and extending, e.g. along the inner wall of the silo upward to a filtering device.

According to the invention the open air-conveying channels provided on the silo bottom, i.e., the bottom surface surrounded by the ring-shaped channel, are inclined with respect to the material feeding openings of the ring-shaped channel. The feeding openings of the ring-shaped channel may advantageously be provided with adjusting slides which can be actuated, f.i. from outside the silo. By means of these slides amounts of material fed to the individual openings of the ring-shaped channel can, if necessary, be controlled.

According to a further characteristic of the invention a control device for the cyclical operation of the air-conveying channels leading to the individual material feeding openings is provided. By means of this control device, known per se, the pneumatic feeding channels leading to the material feeding openings are successively ventilated in a cycle, so that a uniform bulk material introduction into the ring-shaped channel, i.e. into the emptying device proper is achieved. According to the invention, the air-conveying channels on the silo bottom, i.e. the so-called feeding channels, are ventilated separately from the air-conveying channels within the ring-shaped channel.

According to a further characteristic of the invention a distribution cone is provided in the middle of the silo bottom. The slopes of the cone guide the bulk material toward the pneumatic material feeding channels. In silos of extremely large cross section or silos for bulk material of low fluidity it is feasible to employ, instead of the distribution cone, in the middle of the silo bottom, a chamber with lateral material feeding openings and ventilated bottom, similar to the chamber of the mixing device according to German Pat. No. 1,508,888. This chamber is connected unilaterally, be means of a ventilated tunnel, with the ring-shaped channel.

The bottom of the chamber and of the connecting tunnel, or respectively, the air-conveying channels provided thereon, are inclined with respect to the ring-shaped channel.

If a special mixing device is to be connected in series with the silo provided with the ring-shaped channel emptying device of the invention, this can, according to a characteristic of the invention, be accomplished in such a manner that a chamber with a ventilated bottom is attached to the material discharging side of the ring-shaped channel.

The ring-shaped channel may be provided, instead of with only one material discharging opening, with several adjacent and/or superposed openings through which the bulk material enters the mixing chamber.

A pneumatic homogenization apparatus with ventilation that differs according to areas may be installed inside the mixing chamber. The subsequent discharge of the bulk material from the mixing chamber may be carried out laterally.

BRIEF DESCRIPTION OF THE DRAWINGS

Embodiments of the invention are described in the following detail with the aid of the diagrammatical drawings, which show preferred angles approximately to scale.

There is shown.

In the several figures same reference numerals denote same or equivalent parts, and repetitions of necessary parts were omitted for purposes of brevity.

DESCRIPTION OF THE PREFERRED EMBODIMENTS

Figure 1:
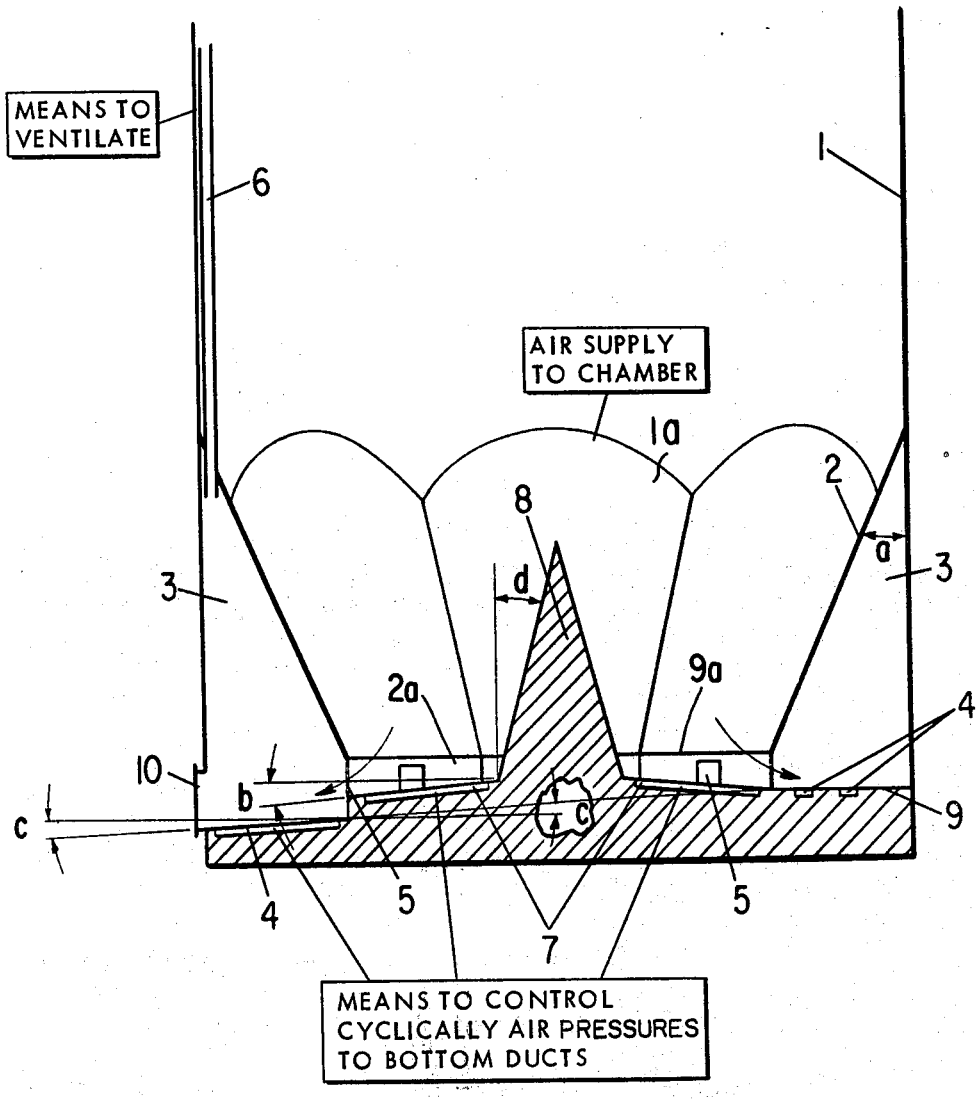
in FIG. 1, a vertical longitudinal section of a silo with ring-shaped channel emptying device.
Figure 2:
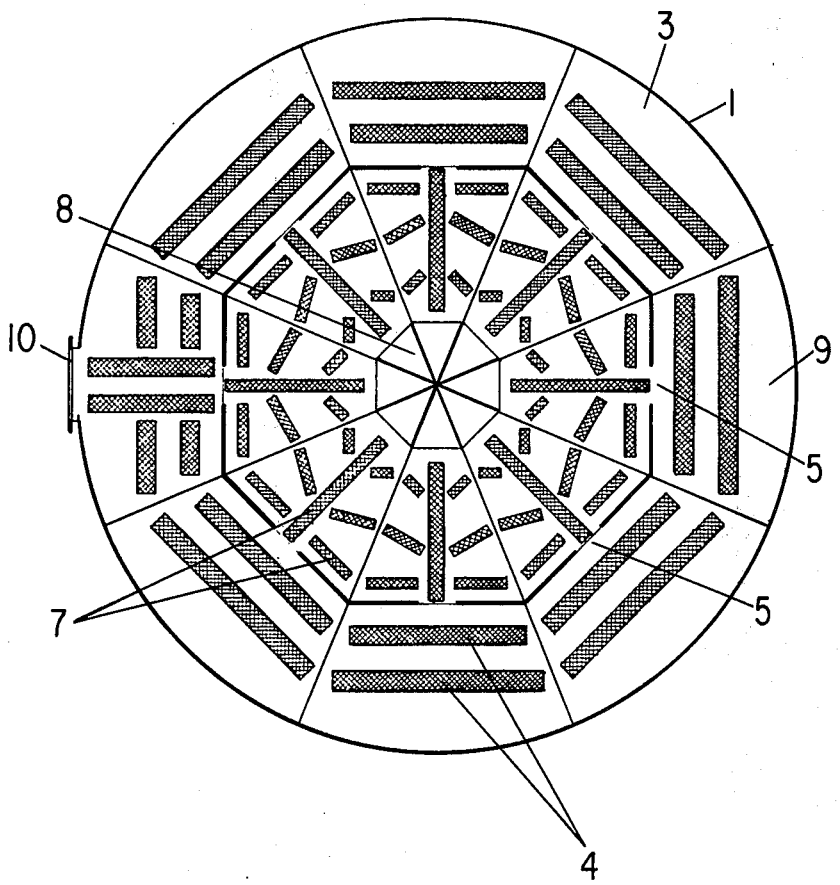
in FIG. 2, a horizontal section of a silo according to FIG. 1.

FIGS. 1 and 2 show a round silo 1, omitting the representation of the upper silo portion with the conventional silo filling devices which are not objects of the invention. The silo is shown provided above its bottom with inner circular slopes 2, inclined from the vertical wall of the silo toward its bottom preferably at a down pressure angle *a* of less than 45°. Preferably the bottoms of the slopes are spaced from the bottom of the silo at a common horizontal lower slope periphery 9*a* and vertical slope walls 2*a* connect the slopes with the silo bottom.

It is conceivable of course to substitute for the planar slopes concave slopes forming troughs.

Thus as shown on the embodiment of FIG. 2 an octagonal silo bottom surface results which defines a material forwarding chamber 1*a* in the downward direction. The slope and bottom surface of the silo can be generally polygonal or round. Within the slopes 2 is provided a ring-shaped channel 3 with open channel airducts 4 at the bottom. There are 8 material release openings 5 between the ring-shaped channel and the inner space through the lower vertical walls of the slopes. The sizes of the release openings can be controlled by adjusting slides by way of rods, e.g. from the outside or below the silo with means to control them.

A ventilating device is provided in the upper area of the ring-shaped channel to ventilate channels 3.

The bottom of the silo is inclined from the middle at a forwarding bottom angle *b* of less than 15° toward the material-release openings and is provided with open bottom airducts 7 preferably with controllably pressurized air supply means.

A distribution cone 8 such as of reinforced concrete or sheet steel rises from the middle of the silo bottom at the cone angle *d* of less than 45°. The distribution cone may be omitted, however, and in such a case the bottom airducts extend in a star-shaped manner to the center of the bottom of the silo.

The bottom of the ring-shaped channel 3 is slightly inclined from its highest point 9 toward a material discharge opening 10 at a symmetrically progressing slope on an outlet angle *c* of about 15°.

Figure 3:
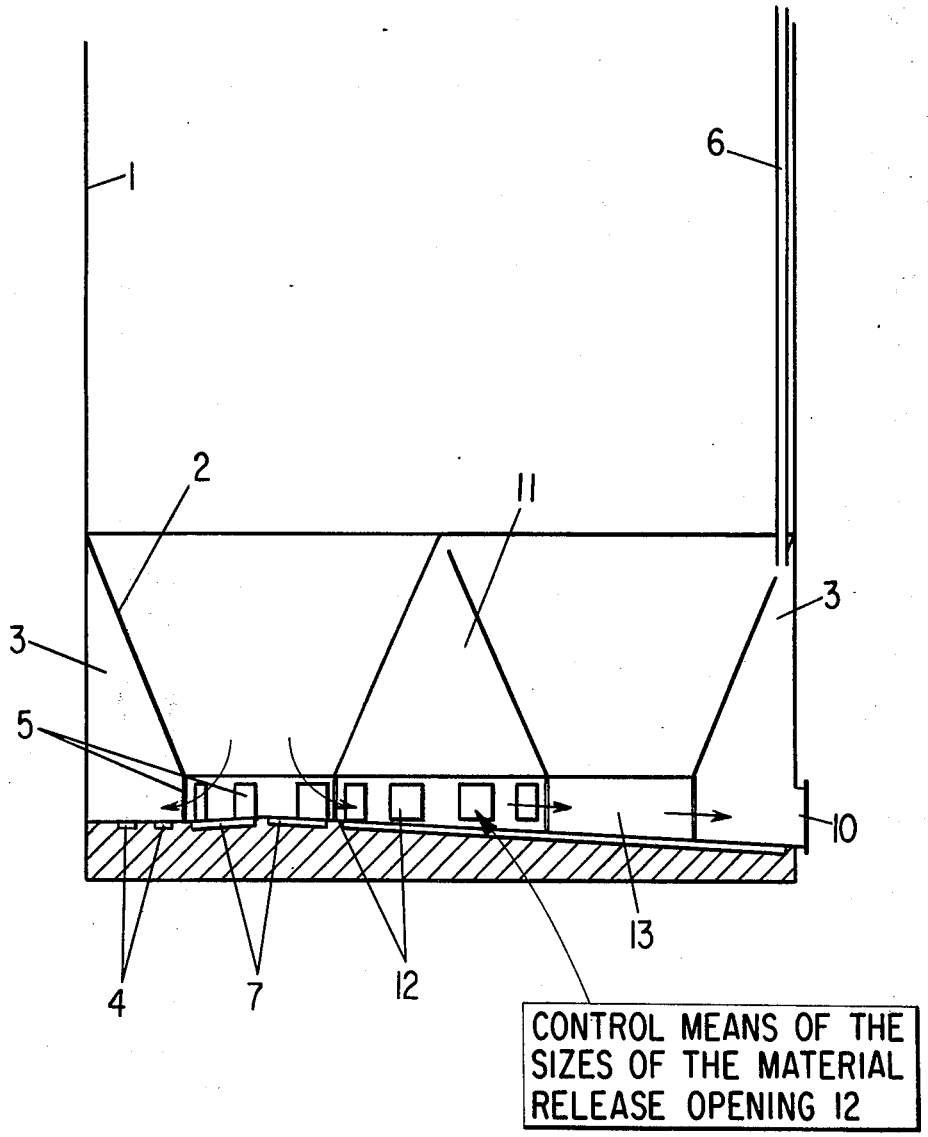
in FIG. 3, a vertical longitudinal section of a silo with a ring-shaped emptying device and additional emptying chamber in the middle of the silo bottom.
Figure 4:
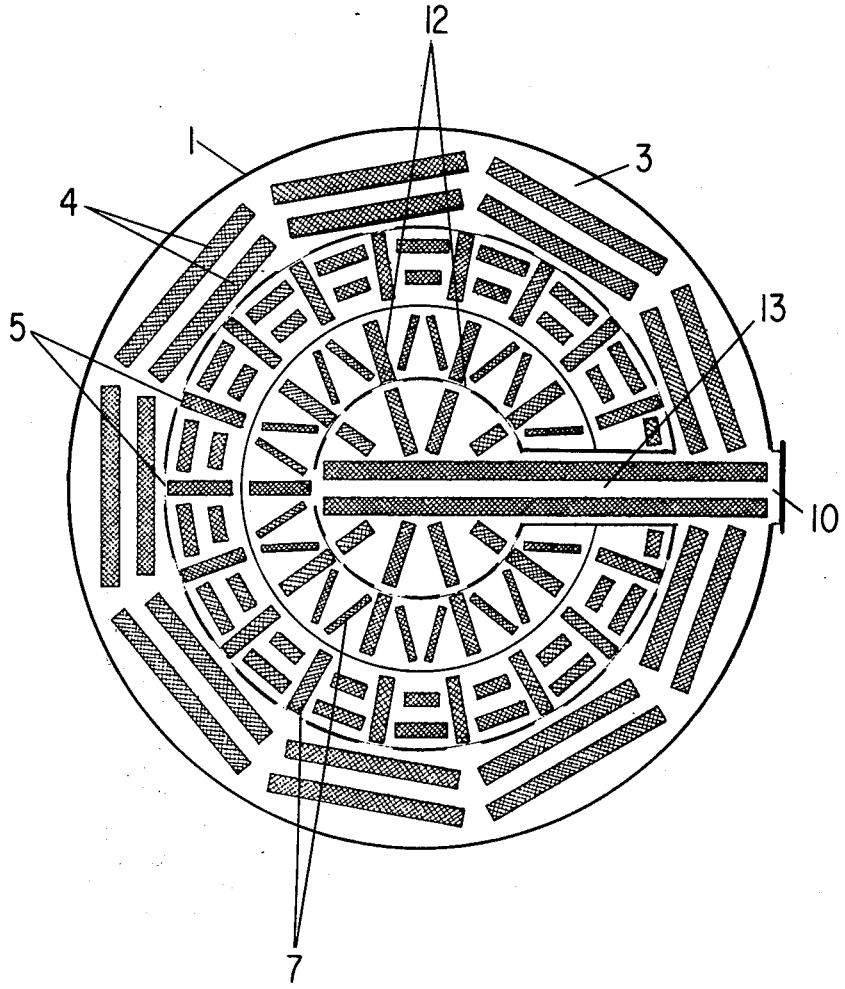
in FIG. 4, the horizontal section of a silo according to FIG. 3; and in FIG. 5, a vertical longitudinal section of a mixing chamber attached to a silo according to FIG. 1 or 3.

In the embodiment of FIGS. 3 and 4 is shown a silo 1 with a circular slope and correspondingly circular silo bottom surface, and with a ring-shaped channel 3 in an arrangement similar to that of FIG. 1. In the middle of the silo bottom is provided an emptying chamber 11. This chamber has lateral material release openings 12 and a material delivery tunnel 13 to the ring-shaped channel 3. The bottom of the emptying chamber and of the tunnel, which bottoms also are inclined with respect to the ring-shaped channel, are provided with open-air channel airducts 4. The ventilation of the emptying chamber and of the connecting tunnel is carried out by way of the ventducts 6 of the ring-shaped channel. The circular-ring-shaped bottom surface of the silo between silo slope 2 and the middle chamber 11 is inclined from the middle of the surface outwardly in the direction of the material feeding openings 5 of the ring-shaped channel 3, and from the middle of the surface inward in the direction toward the material release openings 12 of the emptying chamber 11. The bottom airducts 7 and the several inclinations extend in angles corresponding to those of the embodiment of FIGS. 1 and 2. The three concentric rings, shown on FIG. 4 positioned inside of the silo and outside of the mixing chamber correspond to the three aerating circular ducts 4,7 of FIG. 3.

Figure 5:
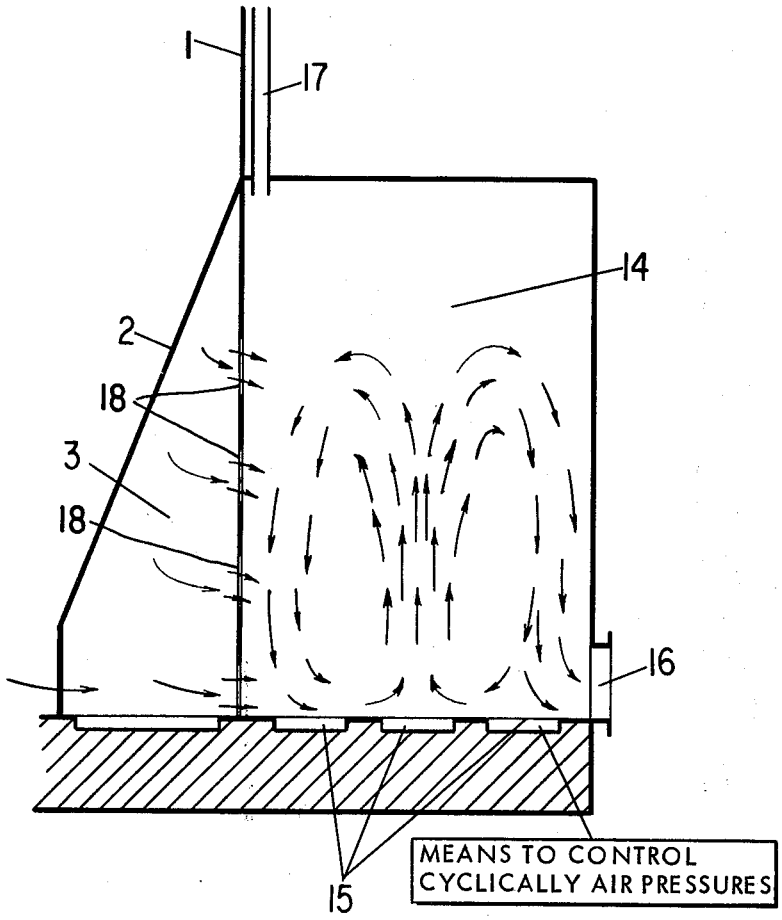

In accordance with FIG. 5 there is provided an attachment of a special mixing device to the material discharge or emptying devices of the invention. The vertical longitudinal section shows a portion of the ring-shaped channel 3 of silo 1, namely, the side of the silo where the material discharge outlet is provided. Instead of the normally existing single material discharge outlet, the ring-shaped channel is in this case provided with several outlet openings 18, adjacent to and elevated in succession in the silo wall and establishing a connection wth a mixing chamber 14 which is attached to silo 1. The mixing chamber has a ventilated bottom 15, a lateral material discharge device 16, and a ventilation device 17 on the top. The mixing of the bulk material discharged from the silo takes place by means of air fed through the ventilated bottom 15. The ventilated bottom can be subdivided into several sections which are ventilated optionally under pressures from atmospheric to intense either in an active or inactive manner. In the embodiment, a division into three sections is provided. At the inlet of the mixing chamber there is a section which is ventilated inactively; at the outlet of the mixing chamber there is likewise a section for inactive ventilation; and between the two there is a section which is ventilated actively by a positive pressure. An air-flow is correspondingly indicated in the drawing.

The angles shown on FIG. 1 are not arbitrary.

The down-pressure angle *a* of the slopes together with the cone angle *d* are generally calculated to guide the silo material by its weight toward the bottom of the silo at a pressure causing automatically discharge of the material through the feed openings, when open.

Since the downward weight of the silo material varies with its mass, and it would be unnecessarily expensive to provide controls of these angles, the discharge is controlled at 7*a* by the sizes of the feed openings 5, which permit taking into account also the amount of the silo material needed at a time.

After the material passes into the interior of the ring channel its further guidance is facilitated manually or by mechanical means by the slope of the angle *c* toward the discharge opening 10.

Therefore the angles shown are calculated to function as optimal for a variety of conditions of the silo materials and demands on their quick availability.

What is claimed is:

1. A silo for fluid bulk material comprising:

a vertical silo housing;

an inner compartment within the said housing adjacent to its bottom, open at the top toward the upper part of the said silo and merging there with the vertical walls thereof;

the walls of the said compartment sloping from the top thereof as slope-walls toward the bottom of the silo and ending in an annular vertical wall extending to the bottom of said silo;

the slope walls of said compartment with the said vertical wall defining together with the bottom section of the walls of said silo an annular channel;

a plurality of material release openings in said vertical wall into said channel;

at least one material discharge opening from the said channel in the bottom portion of said silo to the outside;

open airducts in the bottom of said compartment leading to the individual material release openings with means to supply air to them; and open airducts in the bottom of said channel with means to supply air through them.

2. A silo for fluid bulk material as claimed in claim 1, the bottom of said compartment being inclined toward the said material release openings;

the open airducts being inclined in the bottom of the compartmnt toward the material release openings.

3. A silo for fluid bulk material as claimed in claim 1, further comprising:

means to control the size of the material release openings, actuated from outside the silo.

4. A silo for fluid bulk material as claimed in claim 1, further comprising:

means to control cyclically operation of the air-conveying channels to the individual material release openings.

5. A silo for fluid bulk material as claimed in claim 1, further comprising:

means to supply air to the channel airducts and to the compartment airducts, each separately.

6. A silo for fluid bulk material as claimed in claim 1, the bottom of said channel being inclined toward the material discharge opening.

7. A silo for fluid bulk material as claimed in claim 1, the angle *a* between the compartment slope-wall and the vertical silo wall being less than 45°.

8. A silo for fluid bulk material as claimed in claim 1, the angle *b* of inclination of the bottom of the said compartment from its center toward the material release openings being less than 15°.

9. A silo for fluid bulk material as claimed in claim 1, the angle *c* of inclination of the bottom of the said channel from its highest point toward the discharge opening being about 15°.

10. A silo for fluid bulk material as claimed in claim 1, further comprising:

a distribution cone in the center of the silo bottom.

11. A silo for fluid bulk material as claimed in claim 10, the angle *d* between vertical and the wall of said cone being less than 45°.

12. A silo for fluid bulk material as claimed in claim 1, further comprising an emptying chamber in the center of the bottom of the silo;

said emptying chamber including a vertical enclosing wall at the bottom thereof connected with the bottom of said compartment;

a plurality of material release openings in the said enclosing wall into the interior of said emptying chamber;

a material delivery tunnel leading from the interior of said emptying chamber through said enclosing wall in the direction of said discharge opening through the said channel, the bottom of said emptying chamber being ventilated and inclined toward said material delivery tunnel.

13. A silo for fluid bulk material as claimed in claim 1, further comprising:

a mixing chamber attached to the material discharge side of the channel.

* * * * *